United States Patent [19]

Gould

[11] 4,082,231

[45] Apr. 4, 1978

[54] APPARATUS FOR GRINDING REFUSE

[76] Inventor: Orval E. Gould, Mission Viejo, Calif. 92675

[21] Appl. No.: 636,689

[22] Filed: Dec. 1, 1975

[51] Int. Cl.[2] ..... B02C 13/04

[52] U.S. Cl. ..... 241/187; 241/190; 241/194

[58] Field of Search ..... 241/187, 189 R, 189 A, 241/190, 191, 193, 194

[56] References Cited

U.S. PATENT DOCUMENTS

| | | | |
|---|---|---|---|
| 2,858,082 | 10/1958 | Berling | 241/191 X |
| 3,224,688 | 12/1965 | Beiter | 241/189 R X |
| 3,482,788 | 12/1969 | Newell | 241/194 X |
| 3,813,045 | 5/1974 | Greiffenstern | 241/189 R X |

FOREIGN PATENT DOCUMENTS

| | | | |
|---|---|---|---|
| 1,238,099 | 6/1960 | France | 241/187 |

*Primary Examiner*—Roy Lake
*Assistant Examiner*—Howard N. Goldberg

[57] ABSTRACT

In order to grind refuse, such as municipal waste, two horizontal rotating elements, each carrying a plurality of radiating swinging hammers pivotally attached to discs spaced from each other, are driven in meshing rotation within a housing, the lower inner portion of which presents a series of grate bars extending radially inwardly toward, but spaced from the ends of the swinging hammers. Because the two elements are interconnected for synchronized rotation, the inertia of one element is added to the inertia of the other element to overcome surges of refuse arriving at the entrance of the grinder, which surges might otherwise stall the motor driving only one element. Stationary impact shear bars may be provided at the refuse entrance area of the housing to mesh with the rotating hammers, thereby to cause the ejection of uncrushable objects. The hammers on each disc are disposed on the disc at a different angle about the axle axis from the hammers on each adjacent disc, and openings are provided in each disc to facilitate the mounting of the hammers on adjacent discs.

10 Claims, 5 Drawing Figures

APPARATUS FOR GRINDING REFUSE

BACKGROUND OF THE INVENTION

1. Field of the Invention

This invention relates to rotary grinding and shredding apparatus particularly of the large types which are employed for grinding up and shredding heterogenous refuse, such as municipal waste, into an almost pulverized constituency.

2. Description of the Prior Art

Rotary crushers and grinders have been in use for many decades. Originally such apparatus was developed and utilized in ore crushing operations to enable mining operators and ore processors more easily to extract metals from ore brought out of the earth. Such crushers and grinders would employ some type of heavy cylinder from the surface of which would project a plurality of blunt heads or feet. The ore would be passed between such a cylinder and an adjacent steel wall so that the ore lumps would effectively be hammered against such wall into small enough pieces to pass between the hammers and the wall and on to further processing.

In more recent decades variations of such apparatus have been devised and utilized for the purpose of shredding waste paper and also for breaking up into small components municipal or other waste materials. Municipal waste may consist of a wide variety of discarded items such, for example, as newspapers, cans, boards, wooden and cardboard boxes, broken metal garden furniture, concrete lumps, flower pots, brush, bottles, etc. Apparatus of this type are sometimes called "grinders", "shredders" or "hoggers". A number of models of one such apparatus have been made and sold for a number of years by Enterprise Company of Santa Ana, Calif. and have included as their single horizontal rotating element an axle or shaft upon which are mounted fixedly at varying angles about the shaft axis a series of heavy thick cross-shaped plates spaced from each other. Between each pair of such plates are rotatably mounted a plurality of hammer members with their axes of rotation disposed near the outer extremities of the plates and at points distributed about the shaft axis in such a manner that the axes of rotation of the hammers do not lie in rows, but are spiraled in their disposition about the surface of a projected cylinder coaxial with the shaft. As each part of this element rotates downwardly, its hammers pass downwardly close to a parallelly disposed grating below the element. When refuse is dropped onto the rotating element, it is carried by the latter into a small space separating the element's swinging hammers from the grating where the refuse is then pounded and crushed into small enough particles to pass out through such space to a discharge area.

While such grinders, shredders or hoggers have been very effective in reducing large grindable materials and refuse to relatively small components, several problems have arisen in connection with the operation of such apparatus, namely:

a. Care must be taken to prevent such feeding surges of materials or refuse into the space between the rotating element and the grating as may cause the motor driving the element in rotation to stall. When this occurs, the motor must be turned off and the operator of the apparatus must climb or reach in and throw out by hand a good part of the accumulated refuse which has thus caused the motor to stall.

b. Often refuse components are found to have slipped through between the hammers and grating in sizes which are considered still too large. To remedy this, the oversize items must be picked out of the discharge area and re-run through the apparatus.

c. In order to avoid surges which would stall the apparatus, it has been found desirable to curtail the tonnage of refuse which is dumped into the apparatus' hopper during a given period of time. Such curtailment could require the installation of a second machine in order to enable a plant or facility to process all of the tonnage required to be processed.

d. Occasionally uncrushable objects, such as a cast iron engine block, might be included among refuse being ground. This might not only cause the motor to stall when the item becomes wedged in between the hammer and the surrounding grating, but it might also damage the grating, the hammers or other parts of the apparatus.

e. The cross-shaped plates have been heavy and, as such, have been expensive and difficult to install.

f. Heretofore, the cross-shaping has been felt necessary in order to permit access to pins holding the hammers for their installation and replacement. However, such cross-shaping has tended to prevent the development of smooth inertial force in the rotating element, which force is important in overcoming refuse surges. Instead, there is more of a tendency towards a flywheel effect.

Other manufacturers of this type of equipment have adopted different designs for their rotating elements, such manufacturers being Allis-Chalmers, Inc. of Milwaukee, Wis.; Grundler Company, St. Louis, Mo.; American Pulverizer Co. of St. Louis, Mo.; Williams Patent Crusher Co., of St. Louis, Mo.; and Jacksonville Blowhog, Inc., of Jacksonville, Fla. None of the equipment of such other manufacturers, however, overcomes all of the problems described above. Thus, each of these differently designed shredders, grinders, crushers or hoggers, presents one or more of the problems itemized above, and usually others, depending upon the particular design involved.

SUMMARY OF THE INVENTION

The present invention utilizes a pair of horizontal rotating elements disposed parallel to each other and in hammer meshing engagment with each other, each element being driven by its own motor, but the rotating axles or shafts of the two elements being drivingly connected to each other. Thereby, when any surge of refuse or other material to be ground and shredded occurs, the primary rotating element will have not only its own inertia and motor torque to overcome the surge, but it will also enjoy the back-up inertia and torque of the secondary rotating element.

It is also a feature of the present invention that the entrance to the hammers and grate area have extending therein preceding the grate, a plurality of impact shear bars to intercept any large uncrushable objects and pass them in a direction away from the hammer-grate area.

It is a further feature of the invention to improve the inertia of the rotating elements and their fabrication, servicing and cost by constructing each rotating element as a series of coaxial discs, spaced from each other, between each pair of which the hammers may be rotatingly mounted in a spiralling disposition about the common axis of the discs.

When the two hammer meshingly engaged rotating elements are rotated in the same direction, it will be found that any material which is passed peripherally of the primary rotating element through the space separating such element from the grating will then be further ground into smaller components upon reaching the secondary element and thereupon being driven downwardly again between the hammers of the secondary element and further grating which may be spaced from the arc of rotation of the hammers by a lesser distance than the spacing between the arc of rotation of the hammers on the primary element and its grating.

The present invention also contemplates that the discs between which the hammers are mounted rotatingly in the manner previously referred to, will be orificed in line with the pins which extend through the next two adjacent discs and hold the hammers in their swinging disposition. By this construction, any particular hammer may be replaced at any time without the necessity of having to pull apart the entire element.

DESCRIPTION OF THE PREFERRED EMBODIMENTS

Figure 1:
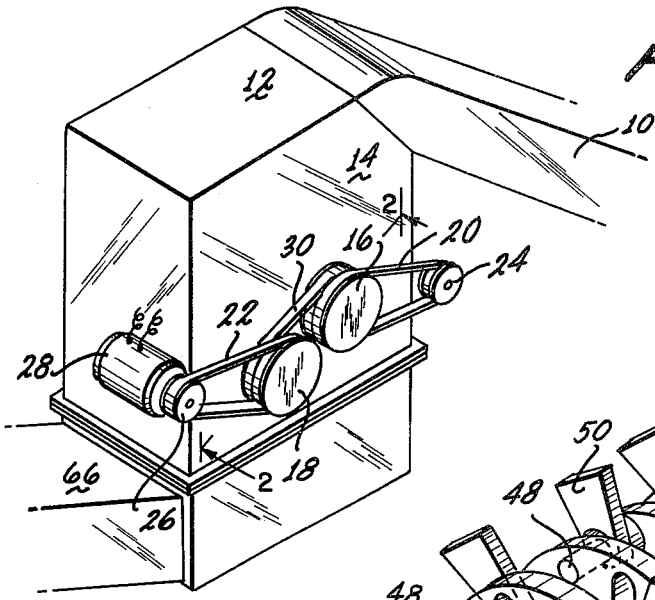
FIG. 1 is a perspective view taken from outside of the housing of an embodiment of the grinder of the present invention.

Referring to FIG. 1, a grinder of the present invention may be incorporated in apparatus which includes a belt conveyor 10 serving to bring refuse or other material to be ground up from an area at the lower end of the conveyor 10 to the top 12 of the grinder housing 14. Within the grinder housing 14, two horizontally disposed rotating elements 16 and 18 are provided and driven in a meshing engagement, as hereinafter described, by belt connections 20, 22, respectively, to the shafts 24, 26, respectively, of separate driving motors, only the motor 28 being shown. It should be noted from FIG. 1 that in addition to each element 16, 18 being connected by belt means to its own driving motor shaft 24 or 26, respectively, the two elements 16 and 18 are drivingly connected to each other by a further belt 30. Desirably the driving motors for both elements 16 and 18 should be synchronized so that both motors start and stop together and rotate their respective elements 16, 18 at identical speeds.

Figure 4:
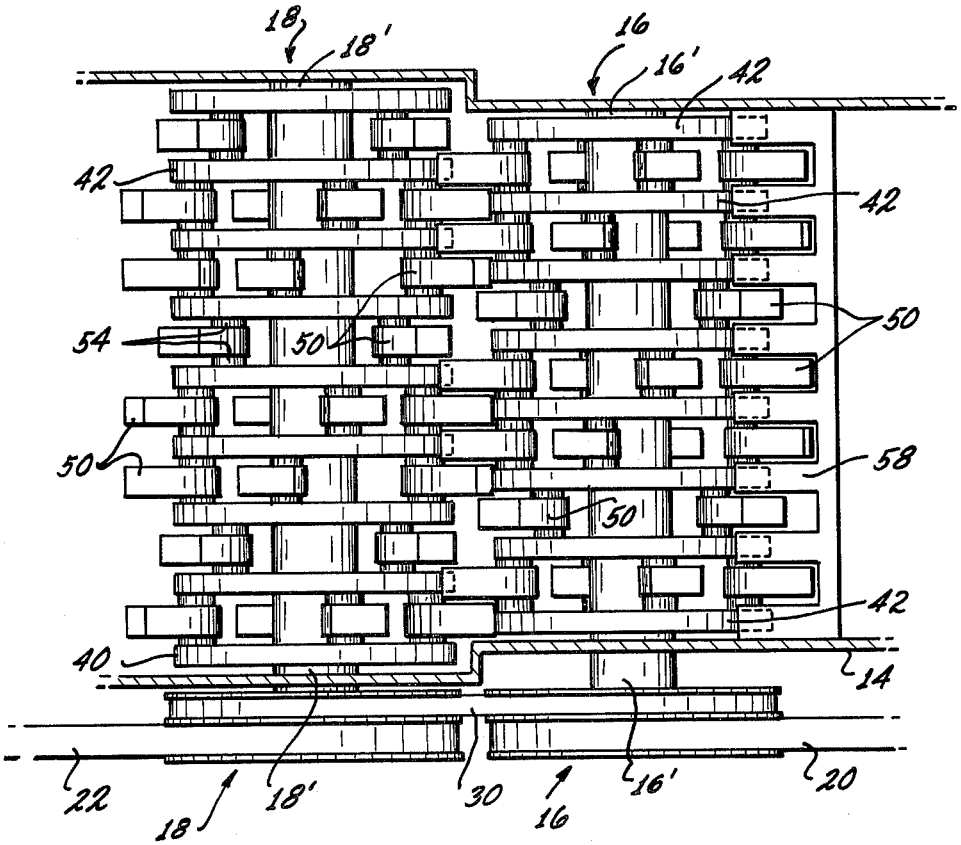
FIG. 4 is a planned view looking in the direction of the arrows 4—4 in FIG. 2.

It should be noted further that the element 16 is disposed at a slightly higher level than the element 18. This disposition of the element 16, 18 may be more clearly seen in FIG. 2. Below the meshing elements 16, 18 within the grinder housing 14 there is provided a double arcuate grate bed 32. This grate bed 32 is comprised of an upper arcuate area 34 and a lower arcuate area 36. Imbedded in each of these arcuate areas 34 and 36 are a series of grate bars 38, each of which projects radially inwardly toward the axis 16' or 18' of the elements 16 and 18, respectively. Each element 16, 18 is constructed almost identically with the other element except, however, as shown in FIG. 4, the axial length of the element 18 may be slightly greater than the axial length of the element 16. Each element 16, 18 comprises an axle 40 on which are fixedly secured a series of coaxial discs 42 which are spaced from each other by a predetermined distance. Each disc has eight pin holding orifices 44 and four access orifices 46. The access orifices are located 90° from each other about the axis 40' of the axles 16', 18' and the pin retaining orifices 44 are disposed at 30° spacing from each other and from each adjacent pair of access orifices 46. Between each pair of discs 42 are rotatingly mounted by pins 48 four hammers 50 at 90° spacings from each other. Each pin 48 extends through an opening 44 in one plate, through the spacing 52 between that plate and the next adjacent plate, and into the registering opening 44 in the next adjacent plate. Annular bushings 54 may be provided on each side of a hammer 50, the smaller rounded inner end of which **50*a* is orificed at 56 to permit a pin 48 to be passed therethrough. In mounting the hammers 50 between adjacent plates 42, it is recommended that each hammer 50 be offset 30° from a hammer mounted between the next adjacent pair of plates. If this offsetting is accomplished progressively, it results in a spiralling of the hammers 50 about the axis 40' of the axle 40 and of the coaxial plates 42. With this progressive offsetting of ajdacent hammers in the axial direction, it will be found that an access opening 46 in each plate will be in register with a pin 48 in the adjacent plate, thereby providing access to such pin 48 through the opening 46. Thereby, hammers 50 may be individually mounted or replaced by the servicing mechanic without the necessity of having to remove the entire assembly 16 or 18 from the grinder housing in order to pull the plates 42 off the axle 40**.

Figure 2:
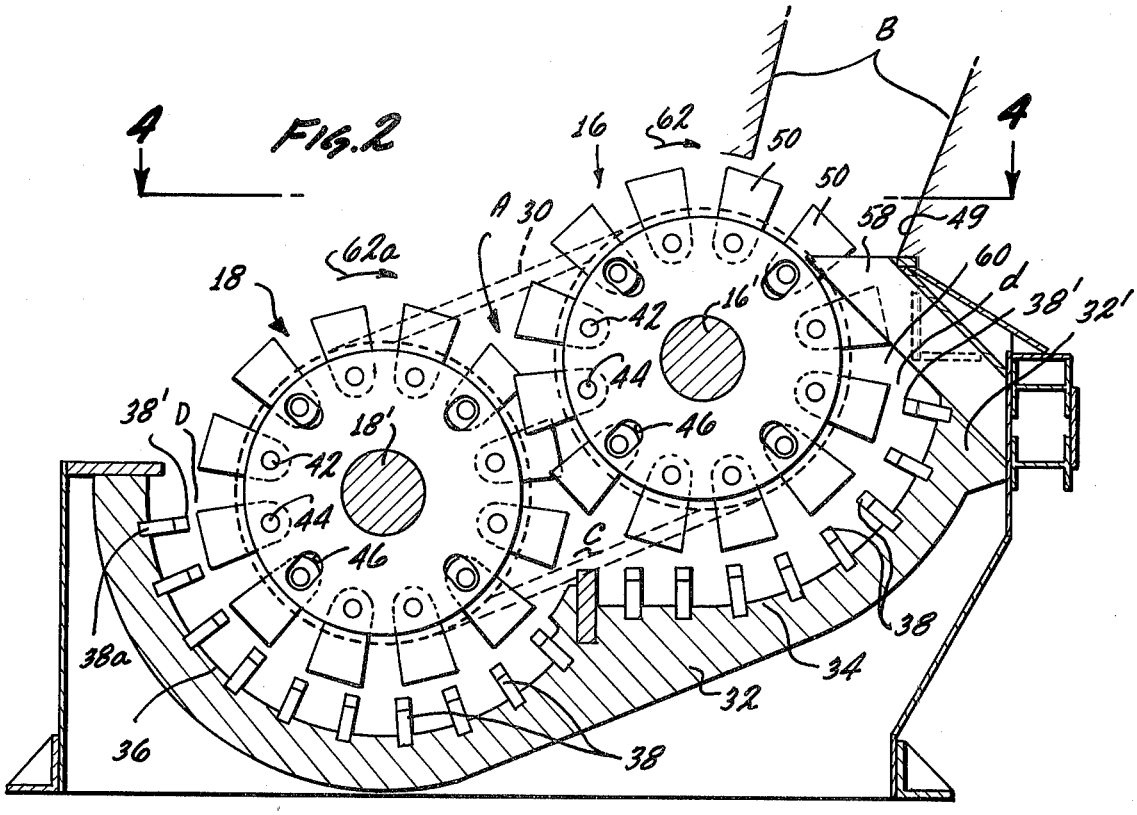
FIG. 2 is a section of a portion of the grinder taken on the line 2—2 of FIG. 1.

The elements 16 and 18 are assembled and mounted in such a way that, as best shown in FIGS. 2 and 4 of the drawings, the hammers 50 of the element 16 in the common area A, swing between the hammers 50 in the element 18 and approach but do not strike the discs 42 of the element 18. Correspondingly, the hammers 50 mounted on the element 18 swing between the hammers 50 and the element 16 and approach, but do not strike the discs 42 in the latter element.

At the upper end 38' of the grate bar bed 38 there are mounted a series of impact shear bars 58. These impact shear bars 58 are of such width and are so spaced from each other that they may extend toward and approach closely the periphery of the disc 16 between the swinging hammers 50, and each bar 58 presents a sharp angle, the lower side of which is almost tangential to the disc 42. The grate bars 38 extend toward but do not intersect the arc of swing of the hammers 50. The spacing *d* between the projecting end 38' of the grate bar 32, and the arc of swing 60 of the hammers 50, nearest the end 32 desirably may be greater than similar spacings between such arcs of swing of the hammers 50 and subsequent grate bar ends 38'. Preferably such spacing will become progressively smaller between the ends 38' of the grate bars 38 disposed further down in the grate bed 32, to the point where the spacing *d'* between the projecting end 38' of the last grate bar **38*a*** is substantially less than the spacing *d*.

Both elements 16 and 18 in FIG. 2 are rotated clockwise in the direction of the arrows 62 and **62*a* so that between the areas A and C, the hammers 50 on element 16 are being swung upwardly, while the hammers 50 on element 18 are meshingly swung downwardly between the hammers 50 of element 16**.

Figure 5:
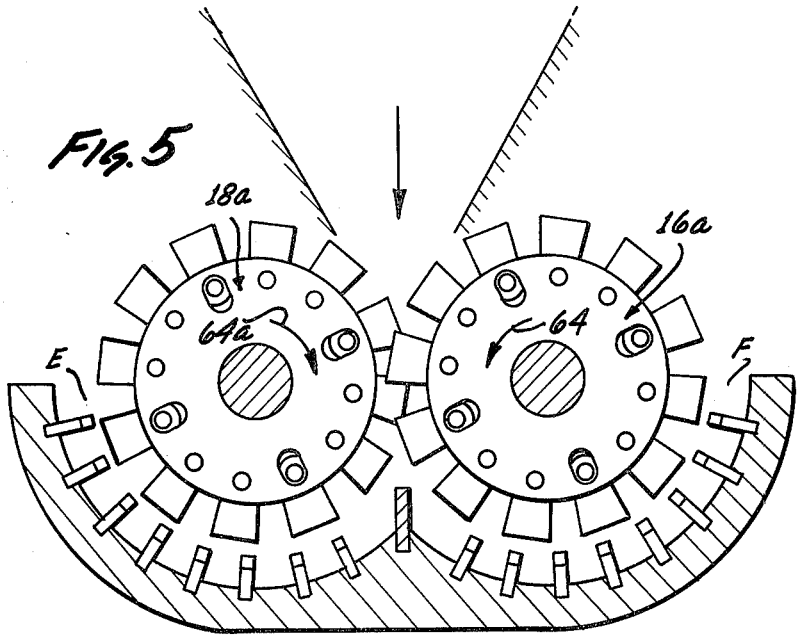
FIG. 5 is a section of a different embodiment of the invention.

In the embodiment of the invention shown in FIG. 5, however, it is contemplated that the elements 16*a* and 18*a* will be rotated in opposite directions as indicated by the arrows 64, 64*a*.

Figure 3:
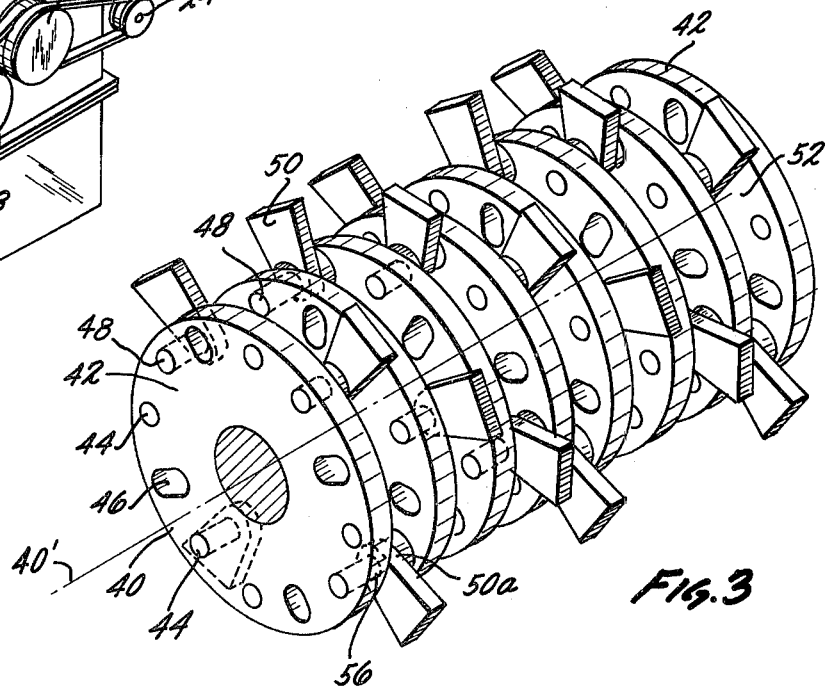
FIG. 3 is a perspective view of one of the rotating elements.

In operation, after refuse is moved up by the conveyor 10 and dumped into the top 12 of the housing 14, it will arrive in the entrance area B (FIG. 3) where it will first come into contact with the hammers 50 as their downward arcs of swing or rotation cut through the lower portion of the area B. At this point, should any uncrushable objects be included in the arriving refuse, such objects should be intercepted by the projecting impact shear bars 58 to be moved outwardly from the remainder of the refuse as it is beginning to be pounded by the swinging hammers 50, and such uncrushable objects will then be conducted away from further contact with the hammers and out a separate passageway 49 for special handling. The remainder of the refuse which is not thus uncrushable, will receive its initial mangling as the hammers 50 pound it through the spaces between adjacent shear bars 58 and down into the spacing *d* between the swinging hammers 50 and the grate bars 38.

After continuous pounding by the hammers 50 of the element 16 as the material is moved between the first grate bar 38 at 32' and the last grate bar in the arcuate area 34 so that it arrives in the area C, the thus-pounded material is then thrown centrifugally in the area C up into the path of the downwardly swinging hammers 50 of the element 18 as they move from the area A into the area C. Thereupon, the material is further pounded and ground against the grate bars 38 in the second arcuate bed portion 36 until the material is finally thrown out in the area D. From here the ground up material then passes to the further conveyor 66 which conveys the ground up material to an area (not shown) from which it may be removed by a vehicle or other conveyance.

It will be appreciated that with the elements 16 and 18 being rotatingly tied together by the belt 30, should there be any such surge of refuse entering the area B (FIG. 3) as might tend to stall the motor driving the element 16 (not shown in FIG. 1) such stalling will tend to be largely inhibited by the backup torque which is developed both by the motor 28 rotating the element 18, as well as by the inertia of the latter element, which back-up torque is conveyed to the element 16 by the belt 30.

In the embodiment of the invention represented by FIG. 5, the two elements 16*a* and 18*a* are rotated in opposite directions. With this directional arrangement, no effort would ordinarily be made to link the two elements together by any belt means, but instead, each would be driven separately by its own motor. This embodiment of the invention could be useful in situations where the surge problem is not likely to be encountered and it is desired to effect a rapid grinding of a large quantity of material or refuse which might not require the prolonged exposure to hammer pounding over the grate bars which occurs in the FIGS. 2 and 4 embodiment of the invention.

From the foregoing detailed description of the present invention, it will be appreciated that apparatus constructed in accordance therewith offers many advantages over apparatus of the prior art and obviates the problems of the type which have heretofore been described.

I claim:

1. An improved apparatus for grinding refuse of a heterogenous composition, said apparatus comprising:

A. a first rotating element, said element rotating about a horizontal axis and formed of a plurality of coaxial discs spaced from each other axially, each said disc being fixedly secured to an axle extending in said axis to rotate therewith, and each adjacent pair of discs carrying a plurality of hammers between them, each said hammer being rotatingly mounted near the peripheries of the adjacent discs with an arc of rotation extending both between said discs and radially outwardly beyond the peripheries of the discs, the hammers between each pair of discs being in a different angular disposition from the hammers between each adjacent pair of discs;

B. a second rotating element similar to the first element, said second element being disposed to rotate about an axis parallel to the axis of rotation of the said first rotating element, said second element being spaced from the first element both radially and axially in such manner that the hammers of the first and second elements, when said elements are driven in rotation, mesh, but none of the hammers of one element strike the periphery of any of the discs of the other element;

C. a housing, said housing extending around both said elements and therebelow, said housing further providing in conjunction with at least one of said two elements, an entrance for the refuse to be ground and an outlet for the refuse after it has been ground by the apparatus;

D. a grate bed disposed below said elements, said grate bed having a plurality of projecting grate bars, said bars extending radially inwardly toward the axis of one of said elements, the outer end of each of said grate bars being spaced by a predetermined distance from the outer ends of said hammers of each said element as said hammers swing outwardly in their respective arcs of rotation;

E. flexible means interconnecting the axles of the first and second elements to cause the second element to rotate at a predetermined speed of rotation in relation to the speed of rotation of the first element and provide a joint inertial force between said two elements:

F. a separate powered driving means connected to drive in rotation each of said first and second rotating elements, each of said separate driving means driving the element to which it is connected at said predetermined speed of rotation thereby to provide said joint inertial force between said two elements.

2. The apparatus as described in claim 1 wherein the first rotating element is disposed at a higher elevation than the second rotating element.

3. The apparatus as described in claim 1 wherein the grate bed is arcuately configured to conform generally to the portions of the cylindrical surfaces presented by the undersides of the two meshing elements.

4. The apparatus as described in claim 1 wherein both elements are rotated by the power driving means in the same rotational direction so that refuse which is ground first between the hammers and the grate bars extending toward the axis of the first element is thrown upwardly into the paths of the downwardly moving hammers of the second element as the last said hammers mesh with the upwardly moving hammers of the first element, to further grind the refuse between the hammers of the second element and the grate bars extending toward the axis of the second element.

5. The apparatus as described in claim 1 wherein the spacing between the arcs of swing of the hammers and the grate bars gradually decreases between the point where the refuse first passes between any hammers and grate bars and the point where the ground refuse last passes therebetween.

6. The apparatus as described in claim 1 wherein each disc of each element is orificed at a plurality of locations disposed angularly about its axis in such a manner that at least some of the orifices in adjacent discs are in register and the hammers are rotatingly mounted between the discs by means of pins extending through registering orifices of adjacent discs.

7. The apparatus as described in claim 6 wherein the hammers are rotatingly mounted between each adjacent pair of discs at an angular offset about the disc axis from the hammers so mounted between adjacent pairs of discs, and access openings are provided in each disc to permit access to the pins of adjacent discs.

8. The apparatus as described in claim 7 wherein the hammers are mounted rotatingly in a spiral pattern around the axle and disc axis of the element.

9. The apparatus as described in claim 1 wherein a series of stationary impact shear bars are provided at the entrance area for the refuse to be ground, said shear bars extending toward the discs between the paths of swing of the hammers whereby uncrushable refuse may be diverted from the entrance to the initial spacing between the grate bars and the arcs of swing of the hammers.

10. An improved apparatus for grinding refuse of a heterogenous composition, said apparatus comprising:

A. a first rotating element, said element rotating about a horizontal axis and formed of a plurality of coaxial discs spaced from each other axially, each said disc being fixedly secured to an axle extending in said axis to rotate therewith, and each adjacent pair of discs carrying a plurality of hammers between them, each said hammer being rotatingly mounted near the peripheries of the adjacent discs with an arc of rotation extending both between said discs and radially outwardly beyond the peripheries of the discs, the hammers between each pair of discs being in a different angular disposition from the hammers between each adjacent pair of discs;

B. a second rotating element similar to the first element, said second element being disposed to rotate about an axis parallel to the axis of rotation of the said first rotating element, said second element being spaced from the first element both radially and axially in such manner that the hammers of the first and second elements, when said elements are driven in rotation, mesh, but none of the hammers of one element strike the periphery of any of the discs of the other element;

C. a housing, said housing extending around both said elements and therebelow and said housing further providing in conjunction with said elements, an entrance area for the refuse, said entrance area being between the two elements, and an outlet on each side of each element for the refuse after it has been ground by the apparatus;

D. a grate bed disposed below said elements, said grate bed having a plurality of projecting grate bars, said bars extending radially inwardly towards the axis of one of said elements, the outer end of each of said grate bars being spaced by a predetermined distance from the outer ends of said hammers of each said element as said hammers swing outwardly in their respective arcs of rotation;

E. powered driving means for each of said elements, one of said driving means driving one of said elements in clockwise rotation and the other of said driving means driving the element in counterclockwise rotation.

* * * * *